US006946606B2

(12) United States Patent
Kitagawa

(10) Patent No.: US 6,946,606 B2
(45) Date of Patent: Sep. 20, 2005

(54) DEPRESSION SWITCH AND MULTIDIRECTIONAL INPUT DEVICE

(75) Inventor: Tsuyoshi Kitagawa, Yao (JP)

(73) Assignee: Hosiden Corporation, Yao (JP)

( * ) Notice: Subject to any disclaimer, the term of this patent is extended or adjusted under 35 U.S.C. 154(b) by 33 days.

(21) Appl. No.: 10/643,869

(22) Filed: Aug. 20, 2003

(65) Prior Publication Data

US 2004/0040826 A1 Mar. 4, 2004

(30) Foreign Application Priority Data

Sep. 4, 2002 (JP) ..... 2002-259185

(51) Int. Cl.[7] ..... H01H 25/04
(52) U.S. Cl. ..... 200/4; 200/6 A; 200/18
(58) Field of Search ..... 200/4, 5 R, 5 A, 200/6 A, 11 R–11 TW, 18, 6 R, 511, 512–517, 314, 406, 292

(56) References Cited

U.S. PATENT DOCUMENTS 4,074,088 A * 2/1978 Keough et al. ..... 200/5 A
4,778,952 A * 10/1988 Watkins et al. ..... 200/5 A
5,459,292 A * 10/1995 Nagano et al. ..... 200/5 R
5,691,517 A * 11/1997 Yamamoto et al. ..... 200/6 A
6,344,620 B1 * 2/2002 Nakamura ..... 200/6 A

FOREIGN PATENT DOCUMENTS

JP 2001-084876 * 3/2001 ..... H01H/25/04

* cited by examiner

*Primary Examiner*—James R. Scott
(74) *Attorney, Agent, or Firm*—Armstrong, Kratz, Quintos, Hanson & Brooks, LLP

(57) ABSTRACT

A depression switch 700 in a multidirectional input device A comprises a key top 710 which is provided below an operating member 400 so as to penetrate a bottom plate portion 211 of a lower case 220 and to be movable in a vertical direction, an elastically deformable dome-shaped movable contact piece 720 abutting the key top 710 moved downward, one fixed electrode 731 provided below an end portion 721 of the movable contact piece 720 on a substrate 100, the other fixed electrode 732 provided at the position of contacting a central portion 722 of the elastically deformed movable contact piece 720 on the substrate 100 and a spacer 740 for electrically connecting the end portion 721 of the movable contact piece 720 to the one fixed electrode 731.

10 Claims, 8 Drawing Sheets

DEPRESSION SWITCH AND MULTIDIRECTIONAL INPUT DEVICE

BACKGROUND OF THE INVENTION

1. Field of the Invention

The present invention relates to a depression switch which inputs various types of signals by being depressed and a multidirectional input device.

2. Prior Art

This kind of multidirectional input device called a joy stick configures an operating member to be capable of being elevated and comprises a depression switch operated by depressing the operating member. Such multidirectional input device with a depression switch comprises a case fixed on a substrate, a pair of upper and lower rotating members supported within the case so as to be rotatable in an X-Y direction, an operating member which penetrates elongated holes provided respectively at the central portions of the pair of upper and lower rotating members and extended in a Y-X direction, which rotates the respective rotating members by being operated in a peripheral direction and which is capable of performing the depression operation, a holding mechanism for elastically holding the operating member and/or the rotating members at neutral positions, a pair of signal detecting means for detecting signals corresponding rotation angles of the rotating members and a depression switch switched by the depression operation of the operating member.

The depression switch conventionally includes a key top which is provided below the operating member so as to penetrate a bottom plate portion of the case and to be movable in a vertical direction, a dome-shaped movable contact piece which is placed below the key top and is elastically deformed when being depressed by the key top descending in accordance with the depression operation of the operating member and a fixed electrode assembly which consists of an outer contact piece formed an the substrate engaged by an end portion of the movable contact piece and an inner contact piece which is fixed and is engaged by the central portion of the elastically deformed movable contact piece contact. Note Japanese Patent Publication Application Laid-Open (JP-A) 2001-84876 (pages 4 to 5, FIGS. 1 and 7).

In accordance with the depression switch, the end portion of the movable contact piece is directly fixed to the fixed electrode, and thus a stroke for the movable contact piece to be elastically deformed cannot be made long. For this reason, the depression switch has drawbacks such as uncomfortable feeling of click and thus inferior operability of depression operation.

SUMMARY OF THE INVENTION

The present invention was developed in view of the aforementioned circumstances and an object of the present invention is to obtain a comfortable feeling of click at the time of depression operation and to provide a depression switch and a multidirectional input device with excellent operability.

A depression switch provided on a substrate relating to the present invention comprises a key top which is provided in a case fixed on the substrate so as to be movable in a vertical direction; an elastically deformable movable contact piece which is abutted against the key top moved downward and has a substantially upside down concave-shaped cross-sectional configuration; one fixed electrode which is provided below an end portion of the movable contact piece on the substrate; the other fixed electrode which is provided at a position of being capable of contacting the central portion of the elastically deformed movable contact piece on the substrate; and a spacer for electrically connecting the end portion of the movable contact piece to the one fixed electrode.

Because of such structure, the spacer can be interposed between the end portion of the movable contact piece and one fixed electrode. Thus, a stroke for the central portion of the movable contact piece to be elastically deformed can be extended.

More preferably, the movable contact piece is formed in a substantially circular dome shape, and the one fixed electrode and the spacer are desirably formed in a substantially annular body.

More preferably, the case is provided with a concave portion for the movable contact piece of the depression switch to be fitted into, and the spacer of the depression switch is desirably provided with engagement means for engaging with the case. Because of such structure, the position of the movable contact piece is restricted by the concave portion of the case and the spacer, so that its misassembling is eliminated.

More preferably, the case is provided with a fitting portion for the key top to be slidably fitted into, and the fitting portion is disposed so that the key top is capable of contacting the central portion of the movable contact piece. Thus, the position of the key top is restricted by the fitting portion and is disposed at the center of the movable contact piece.

A multidirectional input device relating to the present invention comprises a case fixed on a substrate; a pair of upper and lower rotating members supported within the case so as to be rotatable in an X-Y direction; an operating member which penetrates elongated holes provided respectively at central portions of the pair of upper and lower rotating members and extended in a Y-X direction, which rotates the respective rotating members by being operated in a peripheral direction and which is capable of performing a depression operation; a f holding mechanism for elastically holding the operating member and/or the rotating members at neutral positions; a pair of signal detecting means for detecting signals corresponding to rotation angles of the rotating members; and the depression switch switched by the depression operation of the operation member, wherein a key top of the depression switch is provided below the operating member so as to penetrate a bottom plate portion of the case and to be movable in a vertical direction.

DESCRIPTION OF THE PREFERRED EMBODIMENT

Figure 1:
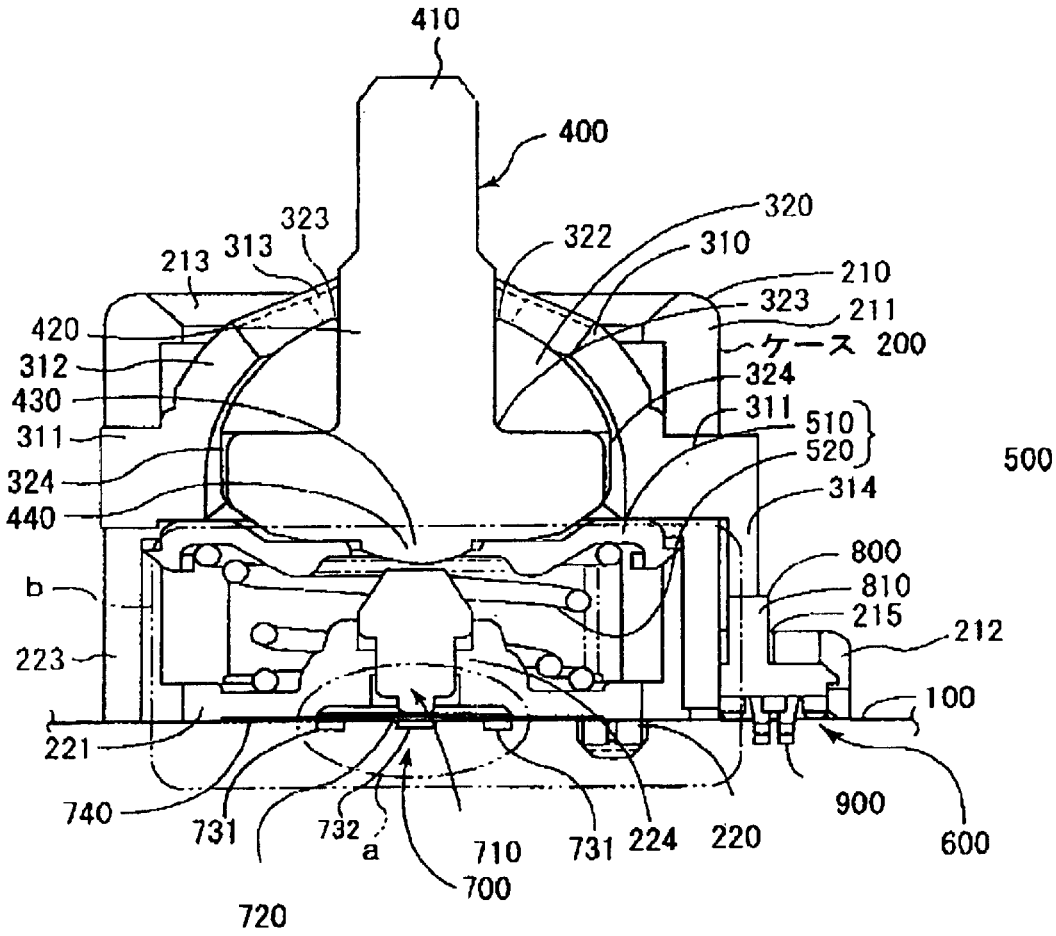
FIG. 1 is a schematic cross-sectional view of a multidirectional input device relating to an embodiment of the present invention.
Figure 2:
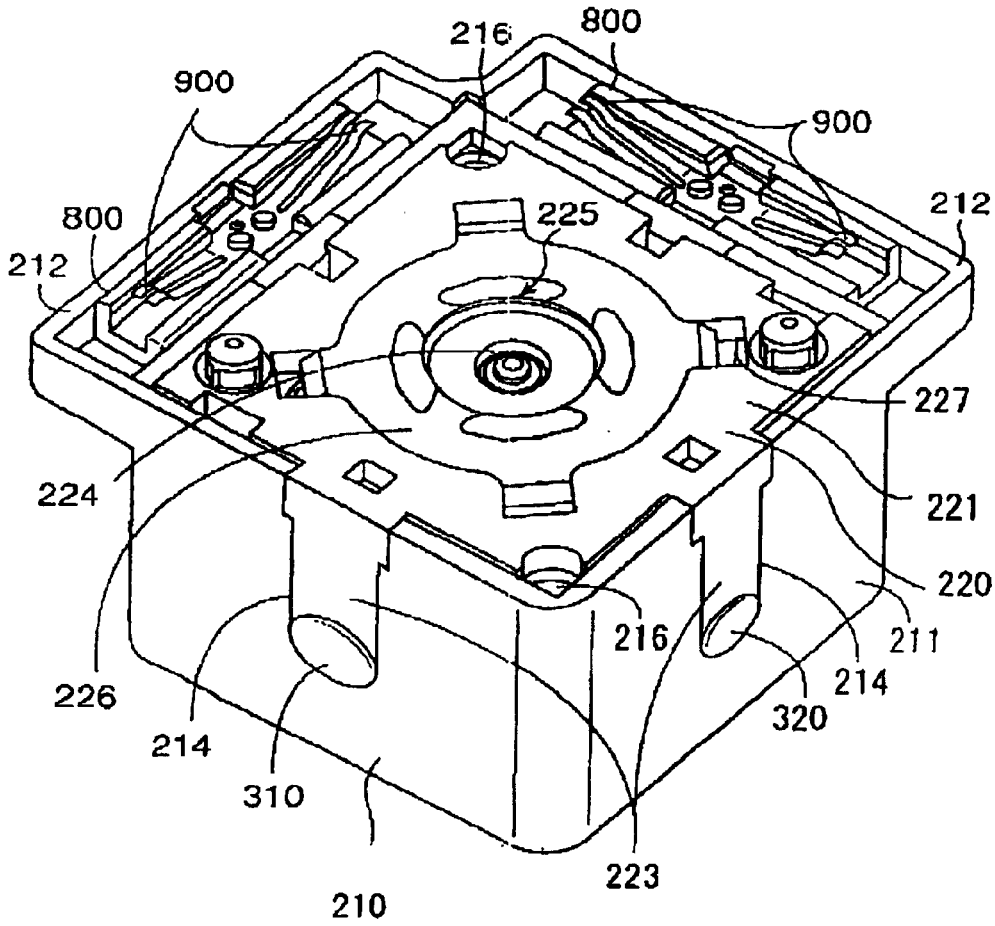
FIG. 2 is a schematic perspective view of the multidirectional input device.
Figure 3:
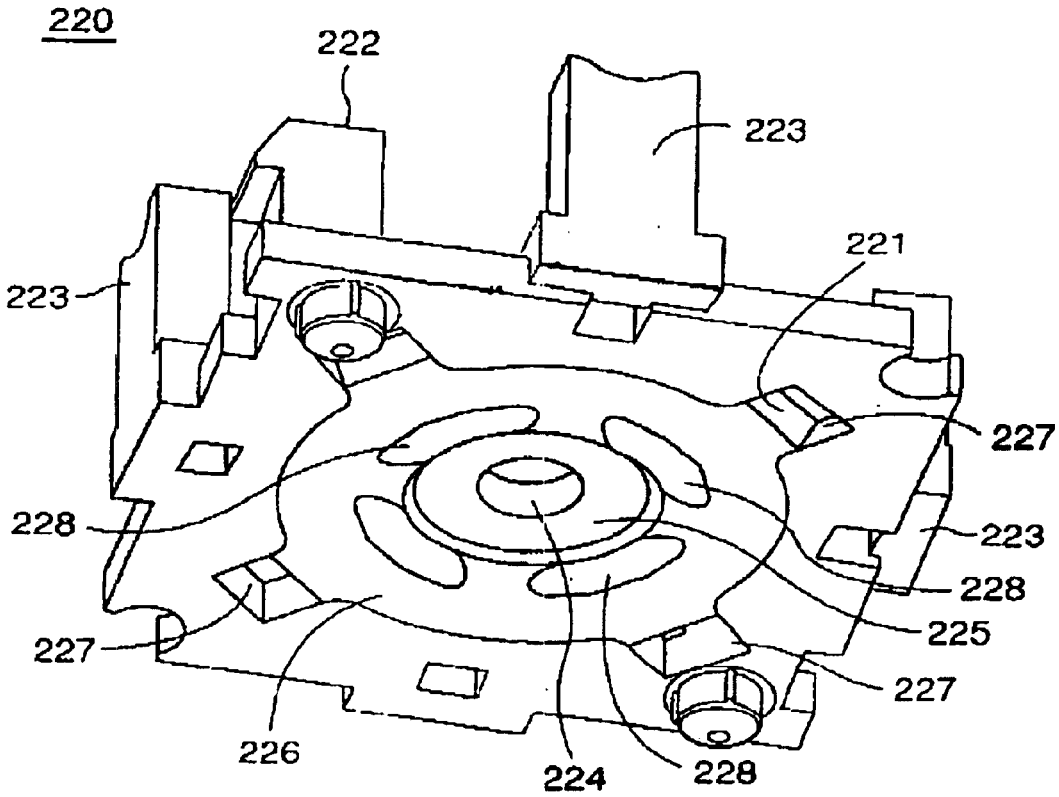
FIG. 3 is a schematic perspective view of a lower case of the multidirectional input device seen from below.
Figure 4:
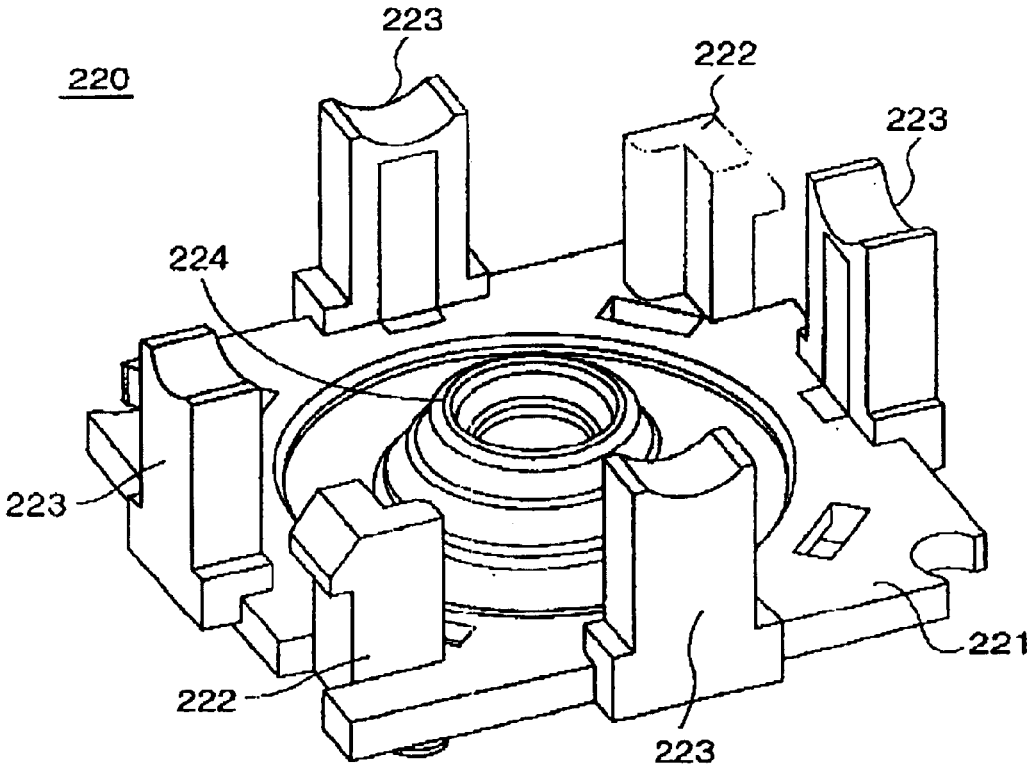
FIG. 4 is a schematic perspective view of the lower case of the multidirectional input device seen from above.
Figure 5:
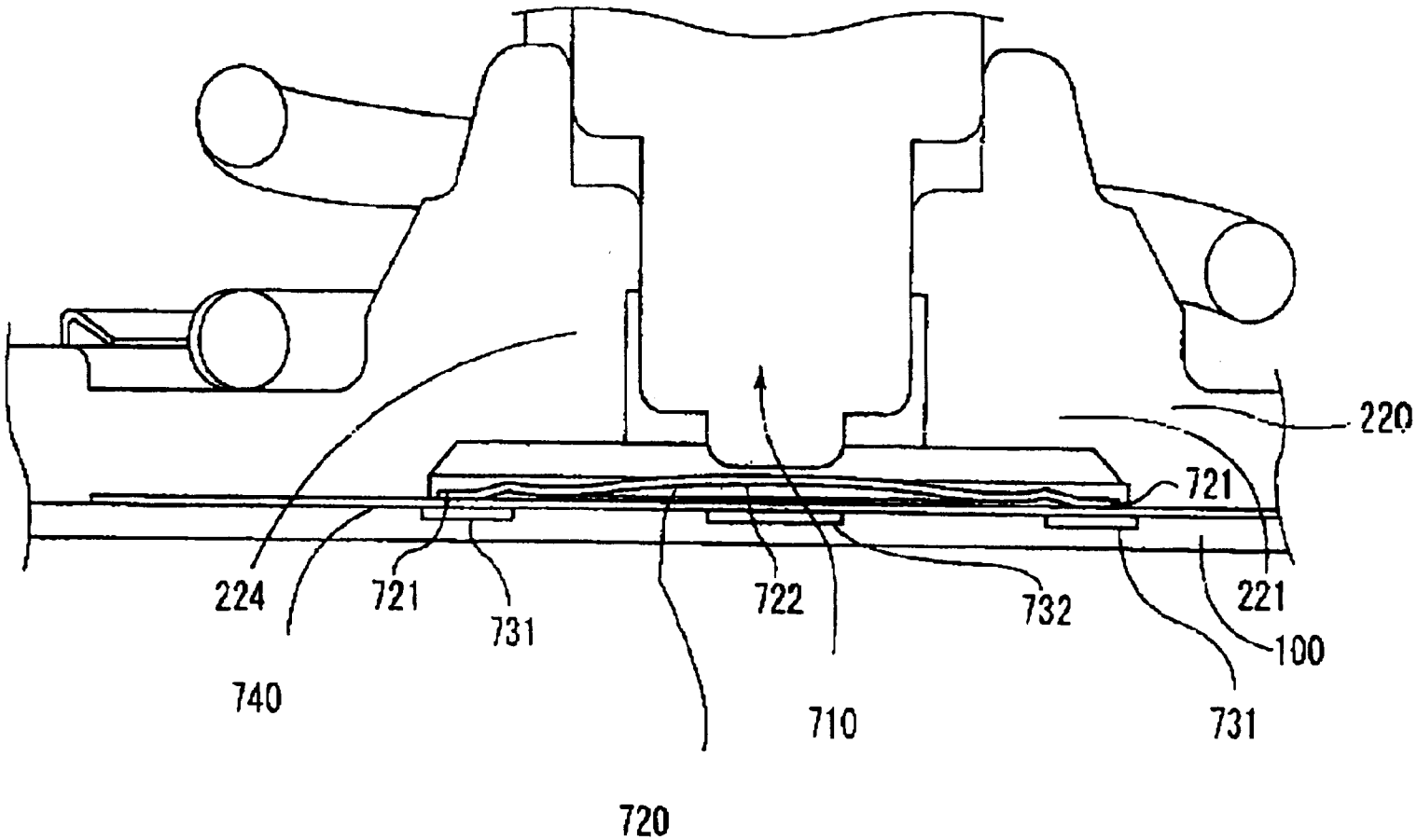
FIG. 5 is an enlarged view of the portion a shown in FIG. 1.
Figure 6:
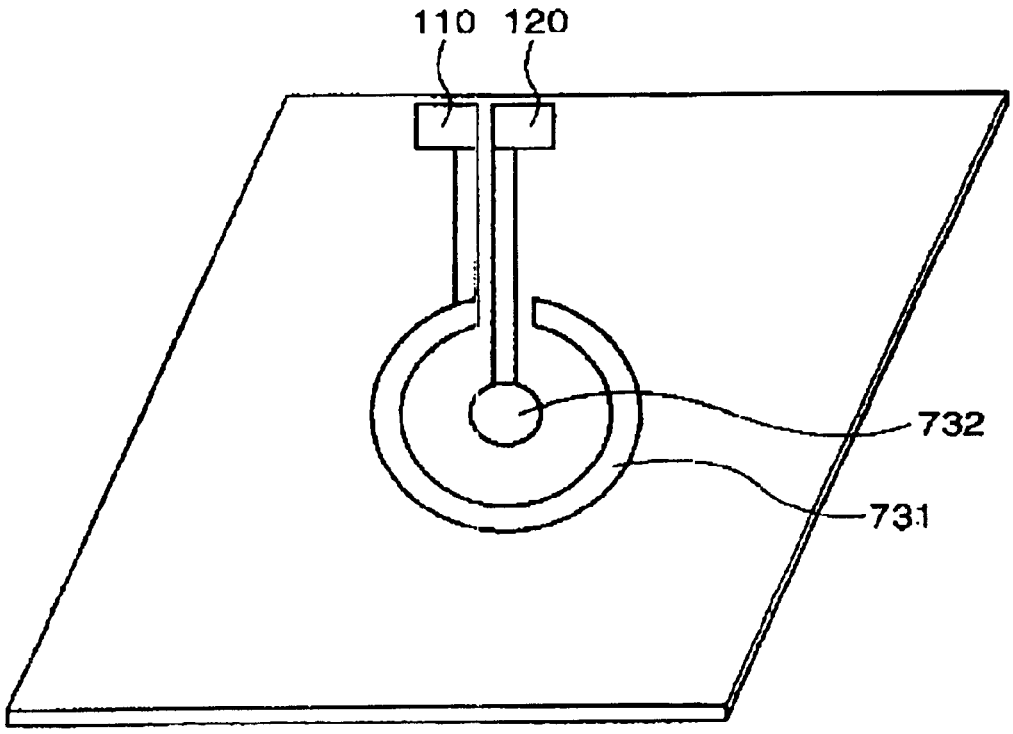
FIG. 6 is a schematic perspective view of a substrate for the multidirectional input device.
Figure 7:
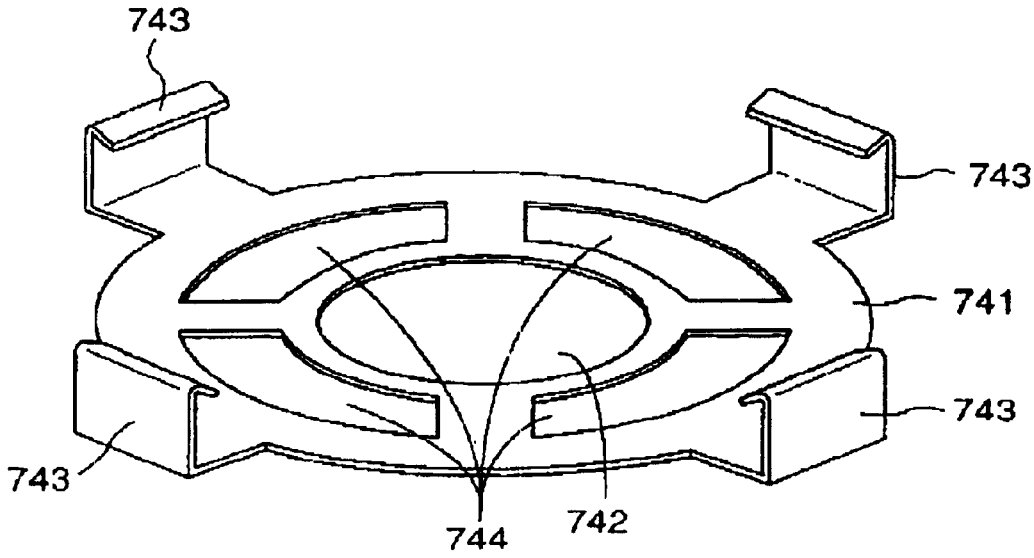
FIG. 7 is a schematic perspective view of a spacer of a depression switch for the multidirectional input device.
Figure 8:
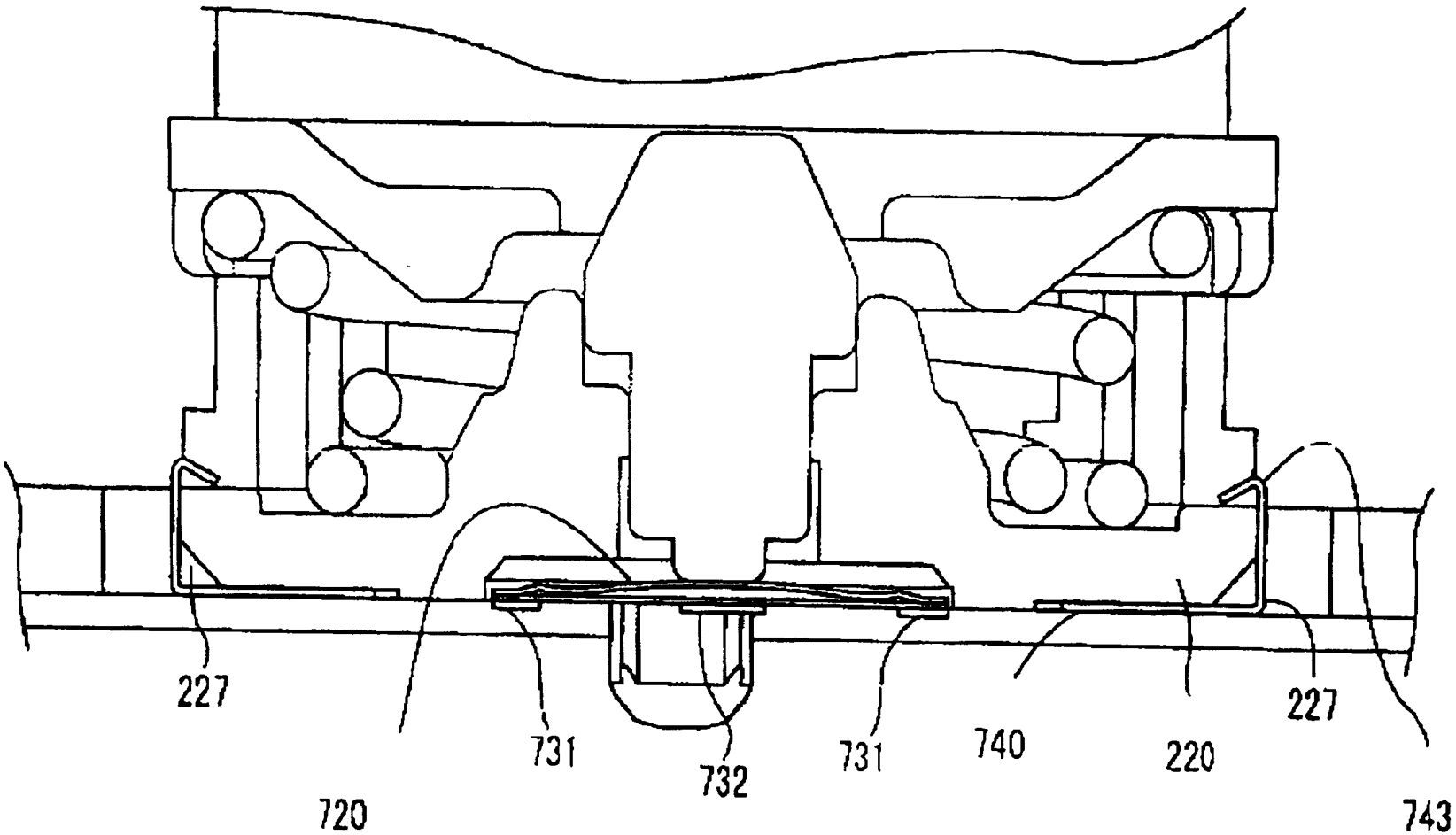
FIG. 8 is an enlarged view of the portion b shown in FIG. 1.

A multidirectional input device relating to an embodiment of the present invention will be described hereinafter with reference to the drawings. FIG. 1 is a schematic cross-sectional view of a multidirectional input device relating to the embodiments of the present invention. FIG. 2 is a schematic perspective view of the multidirectional input device. FIG. 3 is a schematic perspective view of a lower case of the multidirectional input device seen from below. FIG. 4 is a schematic perspective view of the lower case of the multidirectional input device seen from above. FIG. 5 is an enlarged view of the portion a shown in FIG. 1. FIG. 6 is a schematic perspective view of a substrate of the multidirectional input device. FIG. 7 is a schematic perspective view of a spacer of a depression switch for the multidirectional input device. FIG. 8 is an enlarged view of the portion b shown in FIG. 1.

A multidirectional input device A described herein comprises a case 200 fixed on a substrate 100, a pair of upper and lower rotating members 310, 320 supported within the case 200 so as to be rotatable in an X-Y direction, an operating member 400 which penetrates elongated holes 313, 323 provided 1respectively at the central portions of the pair of upper and lower rotating members and extended in a Y-X direction, which rotates the rotating members 310, 320 by operated in a peripheral direction and which is capable of performing a depression operation, a holding mechanism 500 for elastically holding the operating member 400 and the rotating members 310, 320 at neutral positions, a pair of signal detecting means 600 for detecting signals corresponding to rotation angles of the rotating members 310, 320 and a depression switch 700 switched by depressing the operating member 400. The respective portions will be described in detail hereinafter.

The case 200 mounted to the substrate 100 is configured by two pieces, i.e., a lower case 220 with its bottom plate portion being formed and an upper case 210 which is covered on the lower case from above.

The lower case 220 has, as shown in FIGS. 3 and 4, a substantially rectangular bottom plate portion 221. Engagement pieces 222, 222 that are engaged with engagement holes (not shown) for the upper case 210 to be described later are mounted to, among four corners, opposing two corners of the bottom plate portion 221 by screws. Supporting portions 223 for supporting the rotating members 310, 320 are extended upward at the central portions of the respective sides of the bottom plate portion 221.

A cylindrical-shaped fitting portion 224 is provided at the central portion of the bottom plate portion 221. A key top 710 (see FIG. 5) of the depression switch 700 to be described later is fitted into the fitting portion 224 so as to be slidable in a vertical direction. The inner peripheral surface of the fitting portion 224 is formed so as to have a substantially upside down convex cross-sectional configuration (see FIG. 5).

The rear surface side of the bottom plate portion 221 (i.e., the surface opposing the substrate 100) is provided with a cylindrical concave portion 225 so as to be concentric with the fitting portion 224. A movable contact piece 720 (see FIG. 5) of the depression switch 700 to be described later is fitted into the concave portion 225. The outer peripheral of the concave portion 225 is provided with a cylindrical spacer concave portion 226 so as to be concentric with the concave portion 225. Engagement holes 227 to be engaged with engagement pieces 743 (see FIG. 7) of a spacer 740 for the depression switch 700 to be described later are provided at positions opposing four corners of the bottom plate portion 221 on the outer peripheral of the spacer concave portion 226. Convex portions 228 fitted into positioning holes 744 (see FIG. 7) of the spacer 740 for the depression switch 700 to be described later are provided at positions opposing the four corners of the bottom plate portion 221 on the surface of the spacer concave portion 226.

The upper case 210 has a box-shaped main body portion 211 with is lower surface being opened to be covered by the lower case 220 and slider accommodating portions 212, 212 integrally provided with two perpendicular side surfaces of the main body portion 211. An opening portion 213 is provided at a top roof portion of the main body portion 211 for the upper portion of the operating member 400 to be protruded upward. Further, engagement holes (not shown) for engaging with the engagement pieces 222, 222 of the lower case 220 are provided at the side walls of the main body portion 211. Cut-out portions 214 into which supporting portions 223 for the lower case 220 are fitted from below are provided at the respective side walls of the main body portion 211.

Each of the slider accommodating portions 212, 212 is a rectangular parallelepiped shaped box which accommodates a direct advancing slider 800, 800 and is protruded from the lower side surface of the main body portion 211, and its lower surface is opened. The upper surface of each of the slider accommodating portions 212, 212 is provided with a slit opening portion 215, 215 along the side surface of the main body portion 211.

When the upper case 210 is covered on the lower case 220, the engagement pieces 222 of the lower case 220 are engaged with the engagement holes of the main body portion 211 for the upper case 210. Thus, the upper case 210 is fixed to the lower case 220. Further, the supporting portions 223 of the lower case 220 are fitted into the cut-out portions 214 of the main body portion 211 for the upper case 210. Thus, circular opening portions for supporting shaft end portions of the rotating members 310, 320 are formed at the respective side surfaces of the main body portion 211.

The operating member 400 has a bar portion 410 with a circular cross-section, a rotating shaft portion 420 connected to the bottom part of the bar portion 410, a disk portion 430 with large diameter connected to the bottom part of the rotating shaft portion 420 and a semi-spherical convex portion 440 which is provided at the central portion of the lower surface of the disk portion 430 and is protruded downward. The rotating shaft portion 420 is formed so as to have a half-pipe shaped cross-section which is a semi-circular configuration protruding upward, and protruded in two directions perpendicular to the operating member 400. The center of axis for the rotating shaft portion 420 crosses the center of the semi-spherical convex portion 440 protruding downward.

The upper rotating member 310 has, at its end portions, rotating shaft portions 311, 311 with circular cross section. Further, a circular arc portion 312 formed in an arch-shaped configuration protruding upward is provided between the rotating shaft portions. The circular arc portion 312 is provided with an elongated hole 313 extending in the direction of rotation center axis as a guide hole for the operating member 400. A gear portion 314 is integrally formed with the distal end surface of one of the rotating shaft portions 311, 311. The gear portion 314 is protruded toward the side of the main body portion 211 of the upper case 210 and is placed upward of the opening portion 215 of the slider accommodating portion 212. The gear portion 314 is a sector member with its circular arc surface being faced downward, and a spur gear portion (not shown) is formed at the circular art surface thereof.

The lower rotating member 320 is vertically combined with the upper rotating member 310 and has the substantially same structure as that of the rotating member 310. The rotating member 320 is different from the rotating member 310 in that it has a semi-spherical portion 321 protruding upward between rotating shaft portions (not shown) of the rotating member 320. The semi-spherical portion 321 is provided with an elongated hole 322 extending in the direction of rotation center axis as a guide hole for the operating member 400.

A concave portion 323 into which the disk portion 430 of the operating member 400 is fitted is provided at the lower surface of the semi-spherical portion 321. The concave portion 323 assures rotation of the disk portion 430 when the operating member 400 is operated in the direction of the elongated hole 322 of the rotating member 320. A pair of concave bearing portions 324, 324 into which the rotating shaft portion 430 of the operating member 400 is fitted is provided at the inner surface of the concave portion 323 with the elongated hole 322 being sandwiched between the bearing portions.

The holding mechanism 500 for elastically holding the operating member 400 and the rotating members 310, 320 at neutral positions has an annular elevating slider 510 fitted within the main body portion 211 of the upper case 210 so as to be capable of elevating and a spring 520 which is placed below the rotating members 320, 320, which is accommodated in a compressed manner between the elevating slider 510 and the bottom plate portion 221 of the lower case 220 and which urges the elevating slider 500 upward.

The elevating slider 510 elastically surface-contacts, by urging of the spring 520, the flat lower surface of the disk portion 430 of the operating member 400 and the flat lower surfaces formed at the shaft end portions of the rotating members 310, 320 in order to directly hold the operating member 400 and the rotating members 310, 320 at neutral positions. Although the operating member 400 and the rotating members 310, 320 are held, either of them maybe held at its neutral position.

The depression switch 700 switched by depressing the operating member 400 comprises, as shown in FIG. 5, a key top 710 which is placed below the operating member 400 so as to penetrate the bottom plate portion 211 of the lower case 220 and be movable in a vertical direction, an elastically deformable dome shaped movable contact piece 720 which is abutted against the key top 710 moved downward, one fixed electrode 731 provided under an end portion 721 of the movable contact piece 720 on the substrate 100, the other fixed electrode 732 provided at the position of contacting a central portion 722 of the elastically deformed movable contact piece 720 on the substrate 100 and a spacer 740 for electrically connecting the end portion 721 of the movable contact piece 720 to the one fixed electrode 731. These are characteristic portions in the present invention.

The key top 710 of the depression switch 700 has an upside down convex cross-section. The key top penetrates the bottom plate portion 221 so as to be inserted into the cylindrical fitting portion 224 formed at the central portion of the bottom plate portion 221 of the lower case 220. Thus, the key top 710 is disposed above the central portion 722 of the movable contact piece 720. As the inner peripheral surface of the fitting portion 224 of the lower case 220 is formed so as to have an upside down convex cross section, the key top 710 with upside down convex cross section is engaged with the fitting portion 224. Thus, the key top 710 cannot be removed from the bottom plate portion 221 of the lower case 220 because its own weight.

The movable contact piece 720 abutting the key top 710 is formed in a circular dome shape. The end portion 721 (outer peripheral portion) thereof is electrically connected via an annular body 741 of the spacer 740 to be described later to the one fixed electrode 731. When the central portion 722 of the movable contact piece 720 abuts against the key top 710, it is elastically deformed. The diameter of the movable contact piece 720 is smaller than that of the concave portion 225 of the lower case 220 and thus the movable contact piece 720 is fitted into the concave portion 225 of the lower case 220. Although the movable contact piece 720 described herein is formed in a circular dome shape, any movable contact pieces with upside down concave cross-sectional configuration may be used. For example, the movable contact piece 720 may be changed so as to be formed in, e.g., an arch shape.

The one fixed electrode 731 is, as shown in FIG. 6, annularly formed on the substrate 100 by printing and is connected to a plus electrode 110 formed on the substrate 100. The other fixed electrode 732 is formed in a circular configuration by printing on the substrate 100 and provided within the one fixed electrode 731. The other fixed electrode 732 is connected to a minus electrode 120 formed on the substrate 100. The one fixed electrode 731 may be connected to the minus electrode 120 and the other fixed electrode 732 may be connected to the plus electrode 110.

As shown in FIGS. 5 and 7, the spacer 740 is made of conductive metal and has the annular body 741 that an opening 742 is provided at its central portion. Four engagement pieces 743 (engagement means) engaged with the engagement holes 227 of the lower case 220 are extended upward at the outer peripheral portion of the annular body 741. Further, the annular body 741 is provided with four positioning holes 744 fitted into the convex portions 228 of the lower case 220. The spacer 740 is not limited to the annular body 741 and may be intermittently provided along the peripheral direction of the annularly formed one fixed electrode 731. Further, the engagement means of the spacer 740 is not limited to the engagement piece 743 and a convex resin extended from the lower case 220 may be inserted into a hole provided at the spacer 740 and then fixed by thermal deposition.

The movable contact piece 720 is fitted into the concave portion 225 of the bottom plate portion 221 for the lower case 220. Thereafter, as shown in FIG. 8, the engagement pieces 743 of the spacer 740 are engaged with the engagement holes 227 of the lower case 220. The convex portions 228 of the lower case 220 are fitted into the positioning holes 744 of the spacer 740. Thus, the spacer 740 is mounted to the bottom plate portion 221 of the lower case 720. When the spacer 740 is mounted to the bottom plate portion 221 of the lower case 220, the movable contact piece 720 is sandwiched between the concave portion 225 of the lower case 220 and the spacer 740. The position of the movable contact piece 720 is restricted, so that misassembling of the movable contact piece 720 can be prevented. As a result, contact failure thereof can be prevented.

After the spacer 740 is mounted to the bottom plate portion 221 of the lower case 220, the substrate 100 is mounted by screws. The spacer 740 is interposed between the end portion 721 of the movable contact piece 720 and the one fixed electrode 731. Thus, a stroke for the central portion 722 of the movable contact piece 720 to be elastically deformed may be extended. The thickness of the spacer 740 may be set freely. By changing the thickness of the spacer 740, the stroke for the central portion 722 of the movable contact piece 720 to be elastically deformed can be changed.

Each of the direct advancing sliders 800, 800 accommodated within the slider accommodating portions 212, 212 of the upper case 210 is capable of horizontally moving along the side surface of the main body portion 211 of the upper case 210 and is prevented from being removed by a side edge portion of the bottom plate portion 221 for the lower case 220. A convex portion 810, 810 which passes through the slit opening portions 215, 215 provided at the upper surface of the slider accommodating portion 212, 212 so as to protrude upward of the slider accommodating portion 212, 212 is provided at the upper portion of each of the direct advancing sliders 800, 800. A tooth portion which is a rack gear is formed on the upper surface of the convex portion 810, 810 in the movement direction of the direct advancing slider 800, 800. One tooth portion meshes with a tooth portion of the sector gear portion 314 formed at one end portion of the rotating member 310. The other tooth portion similarly meshes with a tooth portion of the sector gear portion formed at one end portion of the rotating member 320.

As shown in FIG. 2, contacts 900, 900 are mounted to the bottom surfaces of the direct advancing sliders 800, 800. The contacts 900, 900 face the surface of the substrate 100 via the opening portions at the lower surfaces of the slider accommodating portions 212, 212, and elastically contact a resistance circuit (not shown) formed on the surface of the substrate 100, so that a volume is configured. The volume serves as the signal detecting means 600. The signal detecting means 600 is not limited to the volume. In addition to the volume, an electric sensor, a magnetic sensor and an optical sensor may be used.

Next, the function of the multidirectional input device A relating to the embodiment of the present invention will be described.

When the operating member 400 is tilted in the direction of the elongated hole 323 of the lower rotating member 320, the upper rotating member 310 is rotated, this operates the signal detecting means 600 and thus a resistance value corresponding to an operation amount can be obtained. Namely, in the signal detecting means 600, the direct advancing slider 800 is moved in accordance with the rotation of the gear portion 314 due to the rotation of the rotating member 310 and the contact 900 is slid on the corresponding resistance circuit, so that the resistance value corresponding to the operation amount can be obtained.

When the operating member 400 is tilted in the direction of the elongated hole 313 of the upper rotating member 310, the lower rotating member 320 is rotated, this operates the signal detecting means 600 and thus a resistance value corresponding to an operation amount can be obtained. Namely, in the signal detecting means 600, the direct advancing slider 800 is moved in accordance with the rotation of the gear portion 326 due to the rotation of the rotating member 320 and the contact 900 is slid on the corresponding resistance circuit, so that the resistance value corresponding to the operation amount can be obtained.

By combining such operations, the operating member 400 can be operated freely in a peripheral direction. Signals corresponding to operational directions and operation amounts are inputted to electronic equipment using the multidirectional input device A.

When the operating member 400 is pushed downward along its axial direction, the depression switch 700 provided below the operating member 400 is operated. Namely, by the operating member 400 being depressed, the movable contact piece 720 is pressed downward via the key top 710. The depressed movable contact piece 720 is deformed downward to contact the other fixed contact piece 732 on the substrate 100. Thus, the one fixed electrode 731 is conducted to the other fixed electrode 732.

As the depression switch 700 is configured so that the spacer is interposed between the end portion of the movable contact piece and the one fixed electrode, the stroke for the movable contact piece to be elastically deformed can be made long. Thus, the feeling of clicking the depression switch 700 becomes comfortable, so that the operability of the depression operation of the multidirectional input device A is improved. The design of the multidirectional input device A may be changed as follows.

In the multidirectional input device A herein, the spacer 740 is interposed between the end portion 721 of the movable contact piece 720 and the one fixed electrode 731. Nevertheless, instead of the spacer 740, a movable contact piece that the same engagement means as that in the spacer 740 is provided may be interposed between the end portion 721 of the movable contact piece 720 and the one fixed electrode 731. By changing the design as described above, an operating force for the movable contact piece 720 can be set to a high load.

In accordance with the multidirectional input device A, structures other than that of the depression switch 700 can be set freely and be appropriately changed. Alternatively, only the depression switch 700 may be utilized as a tact switch.

A depression switch provided on a substrate comprises a key top which is provided in a case fixed on the substrate so as to be movable in a vertical direction; an elastically deformable movable contact piece which is abutted against the key top moved downward and has a substantially upside down concave-shaped cross-sectional configuration; one fixed electrode which is provided below an end portion of the movable contact piece on the substrate; the other fixed electrode which is provided at a position of being capable of contacting the central portion of the elastically deformed movable contact piece on the substrate; and a spacer for electrically connecting the end portion of the movable contact piece to the one fixed electrode.

In according with the depression switch the movable contact piece is formed in a substantially circular dome shape, and the one fixed electrode and the spacer are desirably formed in a substantially annular body.

In the case of the depression switch the spacer can be interposed between the end portion of the movable contact piece and one fixed electrode. Thus, a stroke for the central portion of the movable contact piece to be elastically deformed can be extended. This leads to excellent effects in which a comfortable feeling of click at the time of depression operation can be obtained, and thus the operability is improved. Further, by changing the thickness of the spacer, the feeling of click can be changed.

In accordance with the depression switch the case is provided with a concave portion for the movable contact piece of the depression switch to be fitted into, and the spacer of the depression switch is desirably provided with engagement means for engaging with the case.

In the case of such depression switch the movable contact piece is positioned by concave portion and the spacer. Accordingly, disassembling of the movable contact piece is eliminated and contact failure of the movable contact piece can be prevented.

In accordance with the depression switch the case is provided with a fitting portion for the key top to be slidably fitted into, and the fitting portion is disposed so that the key top is capable of contacting the central portion of the movable contact piece.

In the case of such depression switch the key top is positioned by the fitting portion. As a result, it is possible to eliminate the case in which the key top does not abut the central portion of the movable contact piece.

A multidirectional input device comprises a case fixed on a substrate; a pair of upper and lower rotating members supported within the case so as to be rotatable in an X-Y direction; an operating member which penetrates elongated holes provided respectively at central portions of the pair of upper and lower rotating members and extended in a Y-X direction, which rotates the respective rotating members by being operated in a peripheral direction and which is capable of performing a depression operation; a holding mechanism for elastically holding the operating member and/or the rotating members at neutral positions; a pair of signal detecting means for detecting signals corresponding to rotation angles of the rotating members; and a depression switch switched by the depression operation of the operation member, wherein a key top of the depression switch is provided below the operating member so as to penetrate a bottom plate portion of the case and to be movable in a vertical direction. Because of such structure, the same effects as those in the depression switch can be obtained.

What is claimed is:

1. A depression switch provided on a substrate comprising:

a key top which is provided in a case fixed on the substrate so as to be movable in a vertical direction;

an elastically deformable movable contact piece which is abutted against said key top moved downward and has a substantially upside down concave-shaped cross-sectional configuration;

one fixed electrode which is provided below an end portion of said movable contact piece on said substrate;

other fixed electrode which is provided at a position of being capable of contacting the central portion of said elastically deformed movable contact piece on said substrate; and an electrically conductive spacer for electrically connecting the end portion of said movable contact piece to said one fixed electrode.

2. The depression switch according to claim 1, wherein said movable contact piece is formed in a substantially circular dome shape, and said one fixed electrode and said spacer are formed in a substantially annular body.

3. A depression switch provided on a substrate comprising:

a key ton which is provided in a case fixed on the substrate so as to be movable in a vertical direction;

an elastically deformable movable contact piece which is abutted against said key top moved downward and has a substantially upside down concave-shaped cross-sectional configuration;

one fixed electrode which is provided below an end portion of said movable contact niece on said substrate;

other fixed electrode which is provided at a position of being capable of contacting the central portion of said elastically deformed movable contact piece on said substrate; and an electrically conductive spacer for electrically connecting the end portion of said movable contact piece to said one fixed electrode;

wherein said case is provided with a concave portion for the movable contact piece of said depression switch to be fitted into, and the spacer of the depression switch is provided with engagement means for engaging with said case.

4. The depression switch according to claim 3, wherein said case is provided with a fitting portion for said key top to be slidably fitted into, and said fitting portion is disposed so that said key top is capable of contacting the central portion of said movable contact piece.

5. A multidirectional input device comprising:

a case fixed on a substrate;

a pair of upper and lower rotating members supported within the case so as to be rotatable in an X-Y direction;

an operating member which penetrates elongated holes provided respectively at central portions of the pair of upper and lower rotating members and extended in a Y-X direction, which rotates the respective rotating members by being operated in a peripheral direction and which is capable of performing a depression operation;

a holding mechanism for elastically holding the operating member and/or the rotating members at neutral positions;

a pair of signal detecting means for detecting signals corresponding to rotation angles of the rotating members; and a depression switch of claim 1 or 2 switched by the depression operation of the operation member, wherein a key top of said depression switch is provided below the operating member so as to penetrate a bottom plate portion of the case and to be movable in a vertical direction.

6. A multidirectional input device comprising:

a case fixed on a substrate;

a pair of upper and lower rotating members supported within the case so as to be rotatable in an X-Y direction;

an operating member which penetrates elongated holes provided respectively at central portions of the pair of upper and lower rotating members and extended in a Y-X direction, which rotates the respective rotating members by being operated in a peripheral direction and which is capable of performing a depression operation;

a holding mechanism for elastically holding the operating member and/or the rotating members at neutral positions;

a pair of signal detecting means for detecting signals corresponding to rotation angles of the rotating members; and a depression switch of claim 3 or 4 switched by the depression operation of the operation member, wherein a key top of said depression switch is provided below the operating member so as to penetrate a bottom plate portion of the case and to be movable in a vertical direction.

7. A depression switch provided on a substrate comprising:

a key top which is provided in a case fixed on the substrate so as to be movable in a vertical direction;

an elastically deformable movable contact piece which is abutted against said key top moved downward and has a substantially upside down concave-shaped cross-sectional configuration;

one fixed electrode which is provided below an end portion of said movable contact piece on said substrate;

other fixed electrode which is provided at a position of being capable of contacting the central portion of said elastically deformed movable contact piece on said substrate; and an electrically conductive spacer for electrically connecting the end portion of said movable contact piece to said one fixed electrode;

wherein said movable contact piece is formed in a substantially circular dome shape, said one fixed electrode and said spacer are formed in a substantially annular body, and said case is provided with a concave portion for the movable contact piece of said depression switch to be fitted into, and the spacer of the depression switch is provided with engagement means for engaging with said case.

8. The depression switch according to claim 7, wherein said case is provided with a fitting portion for said key top to be slidably fitted into, and said fitting portion is disposed so that said key top is capable of contacting the central portion of said movable contact piece.

9. A multidirectional input device comprising:

a case fixed on a substrate;

a pair of upper and lower rotating members supported within the case so as to be rotatable in an X-Y direction;

an operating member which penetrates elongated holes provided respectively at central portions of the pair of upper and lower rotating members and extended in a Y-X direction, which rotates the respective rotating members by being operated in a peripheral direction and which is capable of performing a depression operation;

a holding mechanism for elastically holding the operating member and/or the rotating members at neutral positions;

a pair of signal detecting means for detecting signals corresponding to rotation angles of the rotating members; and a depression switch of claim 7 switched by the depression operation of the operation member, wherein a key top of said depression switch is provided below the operating member so as to penetrate a bottom plate portion of the case and to be movable in a vertical direction.

10. A multidirectional input device comprising:

a case fixed on a substrate;

a pair of upper and lower rotating members supported within the case so as to be rotatable in an X-Y direction;

an operating member which penetrates elongated holes provided respectively at central portions of the pair of upper and lower rotating members and extended in a Y-X direction, which rotates the respective rotating members by being operated in a peripheral direction and which is capable of performing a depression operation;

a holding mechanism for elastically holding the operating member and/or the rotating members at neutral positions;

a pair of signal detecting means for detecting signals corresponding to rotation angles of the rotating members; and a depression switch of claim 2 switched by the depression operation of the operation member, wherein a key top of said depression switch is provided below the operating member so as to penetrate a bottom plate portion of the case and to be movable in a vertical direction.

* * * * *